US009470002B2

(12) United States Patent
Irvine et al.

(10) Patent No.: US 9,470,002 B2
(45) Date of Patent: Oct. 18, 2016

(54) TILE LEVELLER AND SPACING SYSTEM

(71) Applicant: ME INNOVATIONS PTY LTD, Glynde, South Australia (AU)

(72) Inventors: Michael Andrew Irvine, Glynde (AU); Enzo Nudo, Glynde (AU)

(73) Assignee: ME INNOVATIONS PTY LTD, Glynde, South (AU)

( * ) Notice: Subject to any disclaimer, the term of this patent is extended or adjusted under 35 U.S.C. 154(b) by 0 days.

(21) Appl. No.: 14/419,707

(22) PCT Filed: Aug. 8, 2013

(86) PCT No.: PCT/AU2013/000876

§ 371 (c)(1),
(2) Date: Feb. 5, 2015

(87) PCT Pub. No.: WO2014/022889

PCT Pub. Date: Feb. 13, 2014

(65) Prior Publication Data

US 2015/0211243 A1 Jul. 30, 2015

(30) Foreign Application Priority Data

Aug. 8, 2012 (AU) ..... 2012903413

(51) Int. Cl.
*E04F 21/18* (2006.01)
*E04F 21/00* (2006.01)
(Continued)

(52) U.S. Cl.
CPC ..... *E04F 21/1877* (2013.01); *E04F 15/02* (2013.01); *E04F 21/0092* (2013.01); *E04F 21/22* (2013.01)

(58) Field of Classification Search
CPC ..... E04F 15/02; E04F 21/22; E04F 21/0092; E04F 21/1877; E04F 15/02452; E06B 1/6069
USPC ..... 52/126.1, 126.5, 384–387, 391
See application file for complete search history.

(56) References Cited

U.S. PATENT DOCUMENTS 7,257,926 B1 * 8/2007 Kirby ..... E04F 15/02005 33/526
8,429,878 B1 * 4/2013 Hoffman ..... E04F 13/0889 52/747.11

(Continued)

FOREIGN PATENT DOCUMENTS

WO WO-2011/012994 A2 2/2011

OTHER PUBLICATIONS

International Search Report for PCT/AU2013/000876, ISA/AU, Woden ACT, mailed Sep. 10, 2013.

*Primary Examiner* — Brian Glessner
*Assistant Examiner* — Adam Barlow
(74) *Attorney, Agent, or Firm* — Harness, Dickey & Pierce, P.L.C.

(57) ABSTRACT

A tile leveller and spacer system that allows rapid and reliable spacing and levelling of tools is described. The tile spacer comprises a base for locating the spacer under the tiles, and a stem that includes an alignment cross which is used to correctly space the tiles. The stem tile spacer is placed over the stem and engages with teeth on the stem. The tile leveller is pushed down over the stem to level the tiles between the base and the bottom of the tile leveller. The stem further comprises a frangible portion located between the base and the tile alignment portion, and when the stem is pulled with sufficient force, the frangible portion breaks to allow removal of the stem. A hand tool may be used to assist in this process. The hand tool can have an adjustable stop which can be set to a first setting to level the tiles, and a second setting to cause the frangible portion to break, allowing removal of the stem and leveller.

7 Claims, 12 Drawing Sheets

(51) Int. Cl.
*E04F 15/02* (2006.01)
*E04F 21/22* (2006.01)

(56) References Cited

U.S. PATENT DOCUMENTS 8,607,530 B2 * 12/2013 Hoffman ..... E04F 21/00 52/747.11
8,966,835 B1 * 3/2015 Hoffman ..... E04F 21/0092 52/122.1
2006/0185319 A1 * 8/2006 Kufner ..... E04F 13/0892 52/749.11
2010/0263304 A1 * 10/2010 Torrents ..... E04F 21/0092 52/126.5
2010/0287868 A1 * 11/2010 Kufner ..... E04F 15/02005 52/391
2014/0298736 A1 * 10/2014 Bunch ..... E04F 21/0092 52/126.1
2014/0325936 A1 * 11/2014 PSaila ..... E04F 21/1877 52/749.11
2015/0184355 A1 * 7/2015 Wang ..... E02D 35/005 52/126.1

* cited by examiner

TILE LEVELLER AND SPACING SYSTEM

CROSS-REFERENCE TO RELATED APPLICATIONS

This application is a 371 U.S. National Stage of International Application No. PCT/AU2013/000876, filed Aug. 8, 2013, which claims priority to Australian Patent Application No. 2012903413, filed Aug. 8, 2012. The disclosures of the above applications are incorporated herein by reference.

TECHNICAL FIELD

The present invention relates to tiling. In a particular form the present invention relates to a system for levelling and spacing tiles.

BACKGROUND

Tiling is both a labour and time intensive job. It requires a highly skilled tradesman to take great care and concentration to ensure a job is finished with outstanding results. High quality results depend on speed of delivery in producing a perfectly flat, even surface finish with little to no imperfections and a consistent appearance throughout.

However there are a number of problems associated with creating an even surface finish. This includes sagging tiles due to glue imperfections and different drying times, air gaps in the glue causing some tiles to sit higher than others, and heat expansion and variable climatic conditions. Tiles must also be correctly aligned relative to each other, as misaligned tiles produce an unsightly aesthetic appearance.

It is very difficult to visually align tiles with the naked eye and thus most tradesmen use mechanical devices to assist with alignment. One common form of mechanical alignment device is a small plastic cross inserted at the junction point of four tiles in the spaces between tiles while the adhesive dries. The width of the cross defines the spacing of the tiles.

Australian Standards require these crosses to be removed before any grout is placed between tiles. However these crosses are difficult to remove as they are usually held tightly between tiles, and as a result many installers leave the crosses in before grouting over the top, which is a direct breach of the standard.

There is thus a need to provide an improved tile spacer and levelling system to assist installers to correctly level and align tiles, or at least provide tile installers with a useful alternative.

SUMMARY

According to a first aspect, there is provided a tile spacer and levelling system comprising:

- a tile spacer comprising:
  - a base for engaging a bottom surface of each of four adjacent tiles to be spaced and levelled;
  - a stem projecting upward from the base, the stem comprising:
    - a tile alignment portion having a cross-shaped profile;
    - a frangible portion located between the base and the tile alignment portion; and
    - a tile leveller for engaging a top surface of the four adjacent tiles,
  - wherein, in use, the tile spacer is located at the intersection of the four adjacent tiles such that the base is located beneath the four adjacent tiles, and each tile abuts a corner of the alignment portion so as to space the four adjacent tiles at a predetermined distance with respect to each other; and
  - wherein the four adjacent tiles are levelled by applying a clamping force on the four adjacent tiles between the base and the tile leveller, to simultaneously level the four adjacent tiles.

In one form the tile leveller further comprises an aperture for receiving the stem portion of the tile spacer. In one form the system further comprising a ratchet mechanism such that the tile leveller is restricted to only move downward along the stem toward the base. In one form the stem comprises a plurality of teeth located above the tile alignment portion, and the tile leveller comprises a stem engaging portion comprising one or more projections for engaging with the plurality of teeth of the stem portion, wherein at least one of the projections and teeth are resilient and orientated to allow one way movement of the stem with respect to the stem engaging portion.

In one form the system further comprises a levelling hand tool comprising a stem receiving portion for gripping the stem, a tile leveller engaging portion, a trigger, and a trigger mechanism wherein actuating the trigger causes the stem receiving portion to be pulled inward with respect to the tile leveller engaging portion, so that in use actuation of the trigger will cause levelling of the tiles. In one form the stem further comprises one or more ribs, and the stem receiving portion of the levelling hand tool comprises a pair of laterally movable opposed grips that engage and grip the ribs when the trigger is actuated. In one form, the levelling hand tool further comprises a height adjustable stop, and in use allows a user to set the maximum height difference between the tile leveller engaging portion and the stem receiving portion when the trigger is actuated. In one form the one or more ribs are located at or above the top of the plurality of teeth on the stem portion.

In one form the levelling hand tool further comprises a barrel, an internal sliding member located within the barrel, a grip and a cap, wherein the forward end of the barrel forms the tile leveller engaging portion, and the rear end of the barrel comprises a threaded aperture, and the cap comprises a threaded shaft that screws into and extends through the threaded aperture and the end of the shaft forms the stop, and the stem receiving portion trigger is located at a forward end of the internal sliding member and is pivotally connected to the trigger, and the trigger is pivotally connected to the grip that is connected to the barrel, such that actuation of the trigger causes the internal sliding member to slide rearward within the barrel until it hits the stop, and the height of the stop relative to the forward end of the barrel is adjustable by screwing the cap, wherein screwing the cap in one direction adjusts the stop inward along the axis of the barrel and screwing the cap in the opposite direction adjusts the stop outward along the axis of the barrel.

In one form the tile leveller comprises a wheel member, and a flat lower surface of the wheel member engages the top surface of the four adjacent tiles, and central portion comprising an aperture for receiving the stem portion of the tile spacer and a plurality of struts that connect the wheel member to the central portion. This ensures the tile joint remains visible during spacing and levelling operation, and allows visual inspection of the tile joint after the levelling operation.

In one form the tile spacer and tile leveller are injection moulded components. In one form the tile spacer is constructed of a translucent or transparent plastic.

According to a second aspect, there is provided a tile spacer for use in the tile spacer and levelling system.

According to a third aspect, there is provided a tile leveller for use in the tile spacer and levelling system.

According to a fourth aspect, there is provided a levelling hand tool for use in the tile spacer and levelling system.

According to a fourth aspect there is provided a method for spacing and levelling tiles using the system described above, the method comprising:

locating a base of the tile spacer under a first tile and an adjacent second tile;

laying a further two adjacent tiles;

spacing the four adjacent tiles using a tile alignment portion on a stem of the tile spacer;

inserting a tile leveller over the stem of the tile spacer;

setting a stop of a levelling hand tool to a first setting to set a separation distance between a forward end of the levelling hand tool and the stop;

placing the levelling hand tool over the stem and actuating a trigger of the levelling hand tool to pull the stem into the levelling hand tool and thus to force the forward end of the levelling hand tool to engage with tile leveller and force the tile leveller down the stem and against the top of the tiles so as clamp the tiles between the base and the tile leveller so as to level the tiles, until the stop prevents further movement of the stem into the levelling hand tool;

removing the levelling hand tool from the stem;

leaving the tiles in a levelled state for a period of time;

adjusting the stop to increase the separation distance relative to the first setting;

placing the levelling hand tool over the stem and actuating the trigger to pull the stem into the levelling hand tool and to force to the tile leveller and against the top of the tiles to force the frangible portion to break; and removing the stem of the spacer and the tile leveller.

A detailed description of one or more embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claims without some or all of these specific details. For the purpose of clarity, technical material that is known in the technical fields related to the invention has not been described in detail so that the present invention is not unnecessarily obscured.

BRIEF DESCRIPTION OF DRAWINGS

Embodiments of the present invention will be discussed with reference to the accompanying drawings wherein.

In the following description, like reference characters designate like or corresponding parts throughout the figures.

DESCRIPTION OF EMBODIMENTS

Figure 1:
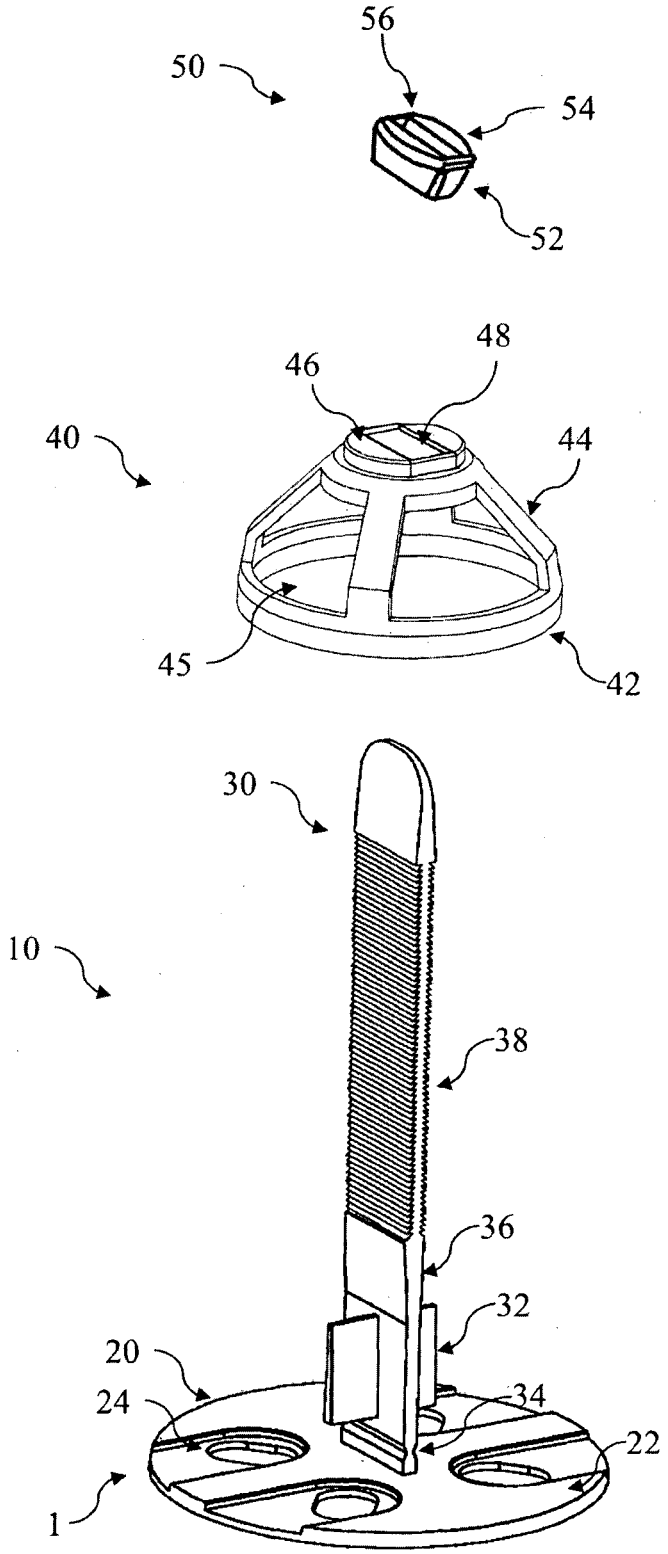
FIG. 1 is an exploded perspective view of a tile spacer and levelling system according to an embodiment of the present invention.

Referring now to FIG. 1, there is shown an exploded perspective view of a tile spacer and levelling system 1 according to an embodiment. The tile spacer 10 comprises a base 20 and a stem 30, and is designed to be placed at the intersection of four adjacent tiles. However the system could also be used to space two or three adjacent tiles, for example at corners or ends.

The base 20 is designed so that a portion of the base 20 will lie beneath each of the four tiles (when laid). The base includes a tile bottom surface engagement portion 22 on the upper surface of the base 20. In this embodiment, the base 20 is a thin circular plate with apertures 24 to allow adhesive to flow through and allows the tiles to the glued to the substrate (eg cement slab) the tiles are laid on.

The stem 30 projects upward from the base 20, and comprises a tile alignment portion 32 having two block-like projections extending outward from the stem so the stem has a regular (symmetrical) cross-shaped profile. In use, each of the four tiles abuts a corner of the alignment portion 32 (formed between arms of the cross) so as to space the four tiles at a predetermined distance with respect to each other. That is, the dimensions of the tile alignment portion 32 ensure that when the tiles are engaged with the portion they will be correctly spaced with respect to each other. A frangible (ie breakable) portion 34 is located between the base 20 and the tile alignment portion 32. The stem 36 extends upward from the tile alignment portion 32.

Figure 2:
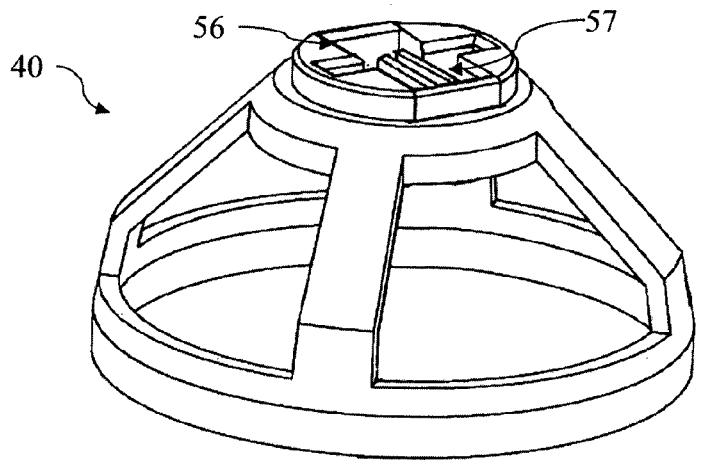
FIG. 2 is a perspective view of a tile leveller according to an embodiment of the present invention.

The system also comprises a tile leveller 40, which in this embodiment comprises a first member and a second member. FIG. 2 shows the assembled tile leveller 40. The first member comprises a tile top surface engagement portion 42 in the form of the flat lower surface of a wheel member, with four vertical struts 44 which connect to a central portion 46 with an aperture or receiving portion 48 for receiving the second member 50. The use of struts creates viewing apertures 45 so the installer has a clear and largely unobstructed view of the tiles and spacer. This allows the installer to visually check that the tiles remain engaged with the tile alignment portion 32 and the tile leveller 40, both before and after the tile leveller has been applied against the tiles.

The second member 50 has a T-shaped profile with the stem 52 of the T designed to be received by the aperture in the first member so that the two members interlock and form an interference fit that can be separated easily by the user. The top portion 54 rests upon the top of the central portion 46 of the first member. The second member also includes an aperture 56 for receiving the stem 30 and that includes a stem engaging portion 57. In this embodiment the stem engaging portion 57 is a pair of vertical plates, each with a series of inwardly directed teeth for engaging the stem, and the base of the plate is connected to the second member via a hinge 58.

Figure 12:
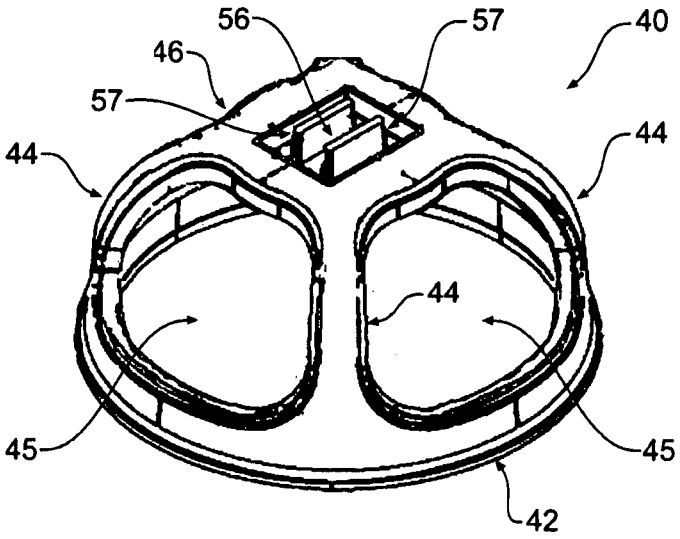
FIG. 12 is a top perspective view of a leveller according to an embodiment.

In other embodiments the tile leveller may be manufactured as a single or all-in-one component with the functionality of the first and second members combined. An embodiment of a unitary tile leveller is shown in FIG. 12. In this embodiment the aperture is formed in the top surface of the leveller, and the hinge 58 extends out from the base of the aperture, and the stem engaging portion 57 is a pair of plates each with a single inwardly directed projection.

Figure 3A:
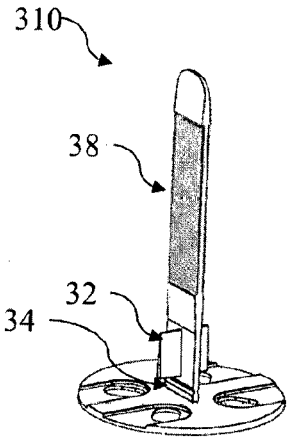
FIG. 3A is a first perspective view of the placement of the tile leveller over the tile spacer according to an embodiment of the present invention.
Figure 3B:
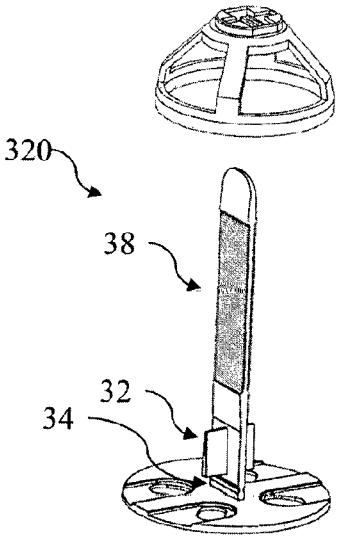
FIG. 3B is a second perspective view of the placement of the tile leveller over the tile spacer according to an embodiment of the present invention.
Figure 3C:
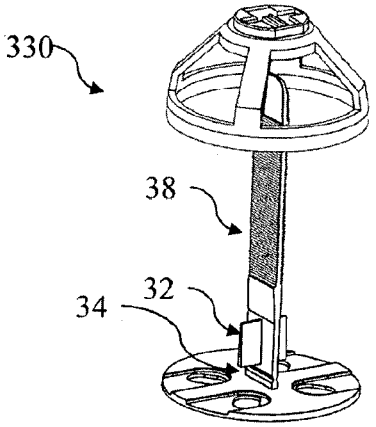
FIG. 3C is a third perspective view of the placement of the tile leveller over the tile spacer according to an embodiment of the present invention.
Figure 3D:
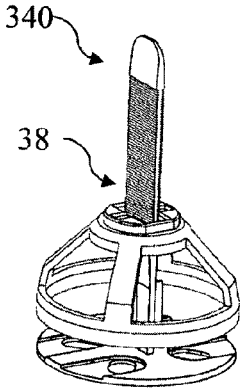
FIG. 3D is a fourth perspective view of the placement of the tile leveller over the tile spacer according to an embodiment of the present invention.

In use, the tiles are levelled by pulling the stem 30 upward towards the leveller so as to apply a clamping force on the tiles, and thus simultaneously level the four tiles between the base 20 and the tile leveller 40. This is illustrated in FIGS. 3A to 3D, which show perspective views of placement of the tile leveller 40 over the tile spacer 10. The tiles have been omitted from the figures for clarity. FIG. 3A shows a perspective view 310 of a tile spacer 10 in a desired location, such as at the intersection of four tiles. In use, the four tiles would be located over the base portion and abut or engage with the tile alignment portion 32. FIGS. 3B and 3C shows perspective views 320 330 of the tile leveller approaching the stem 30, and FIG. 3D shows a perspective view of the leveller 40 located over the stem 30.

Figure 4A:
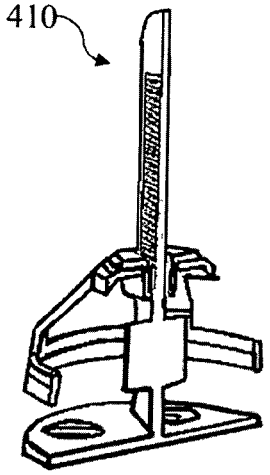
FIG. 4A is a sectional view of the tile leveller fitted over the stem of the tile spacer illustrating a one way ratchet mechanism according to an embodiment of the present invention.
Figure 4B:
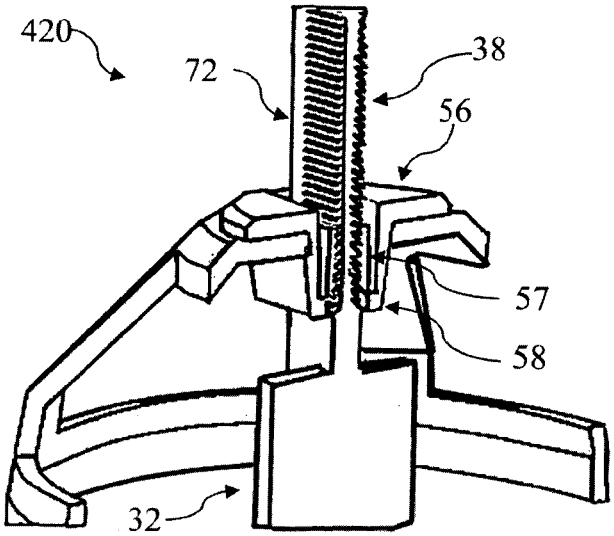
FIG. 4B is a close up view of the ratchet mechanism illustrated in FIG. 4A.

To assist in applying the clamping force to level the tiles, the tile leveller 40 further comprises a ratchet mechanism such that the tile leveller is restricted to only move downward along the stem toward the base 20. A sectional view 410 of the tile leveller 40 fitted over the stem 30 of the tile spacer 10 is shown in FIG. 4A illustrating a one way ratchet mechanism. A close-up view 420 of the ratchet mechanism is illustrated in FIG. 4B.

The stem 30 comprises a plurality of teeth 38 located above the tile alignment portion 32. The tile leveller 40 also comprises a stem engaging portion 57 comprising one or more projections for engaging with the plurality of teeth of the stem portion 30. The stem engaging portion 57 is connected to the edge of the aperture 56 via a hinge 58.

In this embodiment, the teeth 38 on the stem 30 are downwardly directed and the projections on the leveller 40 are upwardly directed teeth. As the leveller 40 is pushed downward with respect to the stem 30, the hinge allows the projections on the leveller 40 to resiliently move outward, before springing back to engage and lock with the next lower set of teeth 38 on the stem 30. Thus, the leveller 40 can be pushed downward along the stem 30 until the leveller 40 engages with the top surfaces of the four tiles. The leveller 40 can then be further pushed downwards to clamp the tiles between the top surface engagement portion of the leveller 40 and the base 20 of the tile spacer 10. That is, pressure on the top surface of the tile causes levelling of the tiles. The engagement of the teeth 38 on the stem with the projections 57 on the leveller ensure the clamping force is maintained (i.e. does not relax). However, other arrangements may also be used. For example, the teeth 38 may be resilient and orientated to allow one way movement of the stem 30, or both the teeth 38 and projections may be resilient.

Figure 9A:
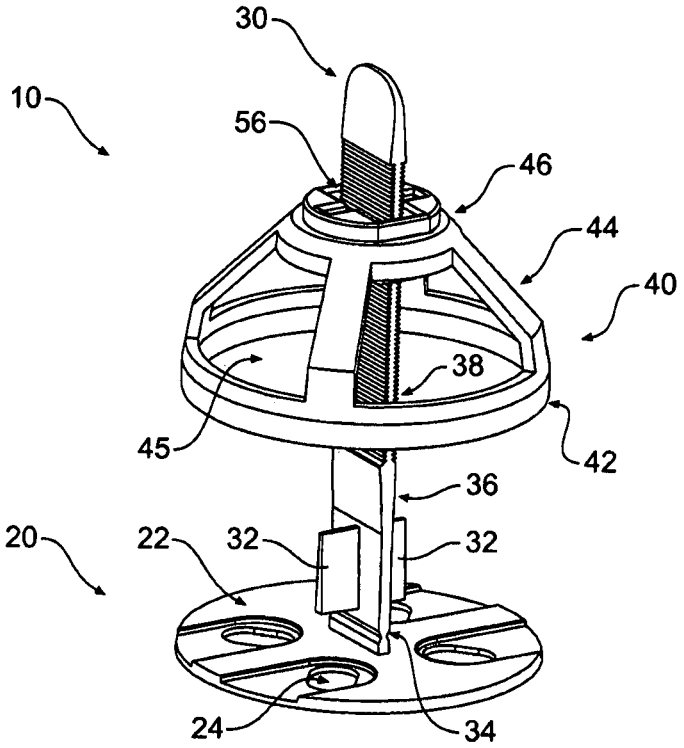
FIG. 9A is a top perspective view of a tile spacer and leveller according to an embodiment.
Figure 9B:
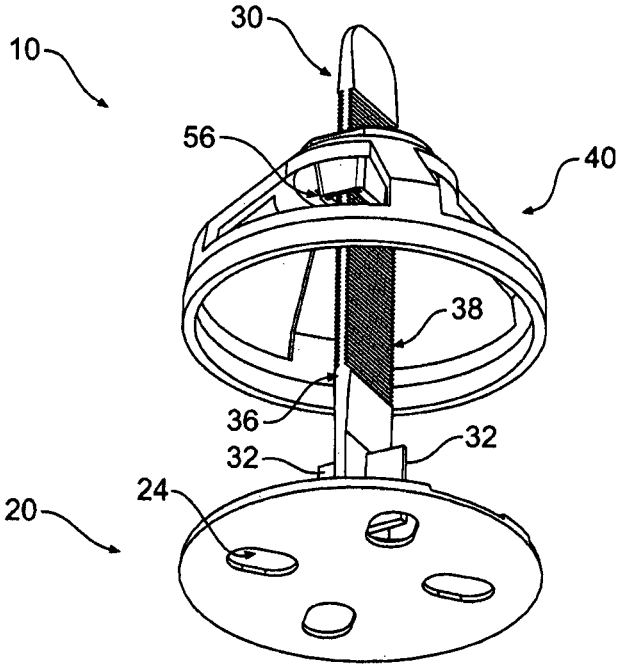
FIG. 9B is a underside perspective view of a tile spacer and leveller according to an embodiment.
Figure 10A:
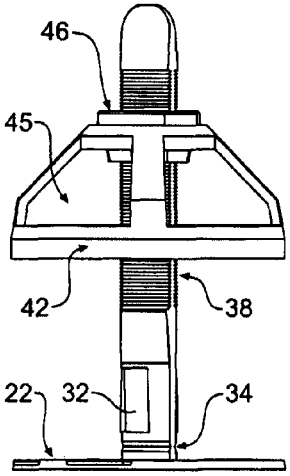
FIG. 10A is a first side view of a tile spacer and leveller according to an embodiment.
Figure 10B:
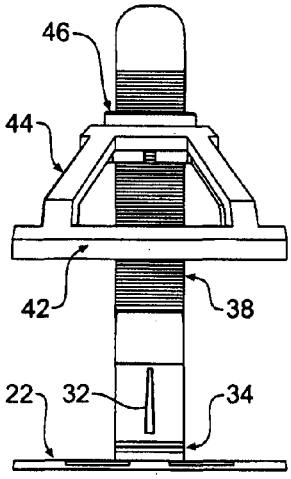
FIG. 10B is a front view of a tile spacer and leveller according to an embodiment.
Figure 10C:
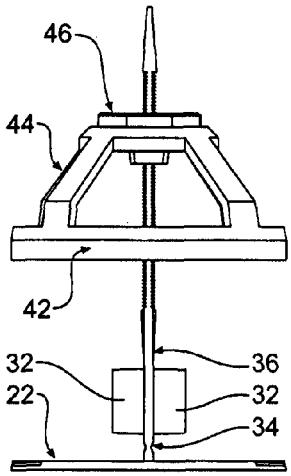
FIG. 10C is a second side view of a tile spacer and leveller according to an embodiment.
Figure 10D:
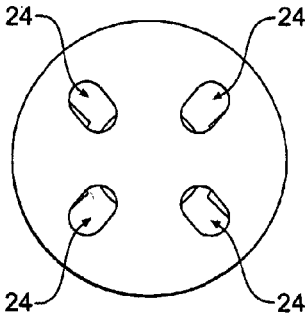
FIG. 10D is an underside view of a tile spacer and leveller according to an embodiment.
Figure 10E:
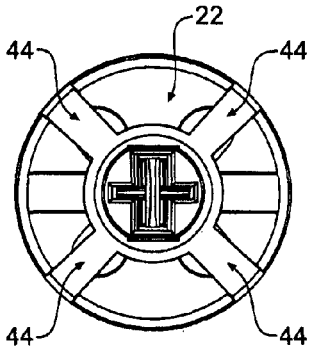
FIG. 10E is a top view of a tile spacer and leveller according to an embodiment.

FIGS. 9A and 9B show top and underside perspective views, respectively of a tile spacer with the tile leveller engaged on the stem. FIGS. 10A, 10B and 10C show a first side view, a front view, and a second side view respectively corresponding to the perspective views shown in FIGS. 9A and 9B. FIG. 10D is an underside view and FIG. 10E is a top view.

Figure 5:
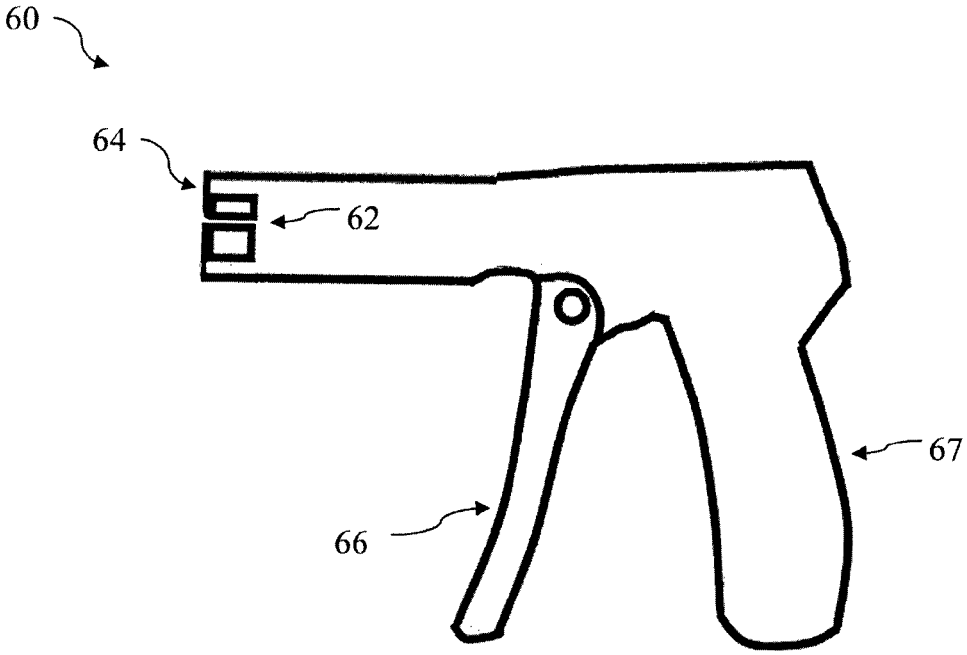
FIG. 5 is a side view of a levelling hand tool.

To assist with placing the leveller 40 onto the stem 30, a levelling hand tool 60 as illustrated in FIG. 5 may be used. The hand tool 60 comprises a stem receiving portion 62 for gripping the stem 30, a tile leveller engaging portion 64, a trigger 66 which is squeezed with respect to a pistol grip 67, and a trigger mechanism wherein actuating the trigger 66 causes the stem receiving portion to be pulled inward with respect to the tile leveller 40, so that in use actuation of the trigger 66 will cause levelling of the tiles. For example, the stem receiving portion 62 may include a plurality of projections to engage with the teeth 38 of the stem 30 (similar to the arrangement in the leveller 40). A linkage arrangement may be used so that when the trigger 66 is squeezed, the projections are brought into engagement with the teeth 38 on the stem 30, and are then pulled rearward.

As the stem is pulled rearward, the tile leveller engaging portion 64, which is a flat surface at the front of the hand tool engages with the top portion 54 of the leveller, and pushes the leveller 40 downward (along the stem 30) until the leveller 40 engages with the tile surfaces. Further pressure is then applied (by squeezing the trigger further) to clamp the tiles between the leveller 40 and the base 20. The trigger can then be released and the stem 30 will be released from the hand tool 60. However, the clamping force is maintained after release of the hand tool 60, due to by the teeth 38 on the stem 30 engaging with the projections 57 on the leveller 40 so as to prevent upward movement of the leveller 40 and relaxation of the clamping force. As can be seen in FIG. 3D, the use of struts to create viewing apertures allow the installer to inspect that the tiles have been correctly spaced and levelled after the leveller has been forced against the tiles. The teeth ensure the downward levelling force can be maintained once the tool is removed. This allows time for the adhesive to cure.

As illustrated in FIG. 1, the stem 30 includes a frangible portion 34 located between the base 20 and the tile alignment portion 32 to allow separation of the stem 30 and leveller 40 from the base 20 once the tiles have been levelled and spaced. The time between application of the levelling force, and separation and removal of the stem and leveller is left at the discretion of the installer. For example, if the adhesive is quick-setting, the separation and removal may be performed soon after the levelling operation. Alternatively the leveller 40 and spacer 10 may be left for a period of time (eg a day) to allow the adhesive to cure before the separation and removal of the stem 40 and leveller 10. The stem and leveller can then be disposed of. Alternatively, if desired, the stem can be separated from the leveller (eg by pushing the stem all the way through the aperture in the leveller), and the leveller may be reused.

Figure 6A:
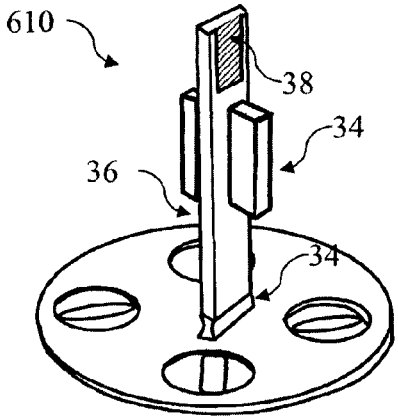
FIG. 6A illustrates a perspective view of a frangible portion located between the base and the tile alignment portion of the tile spacer according to an embodiment of the present invention.
Figure 6B:
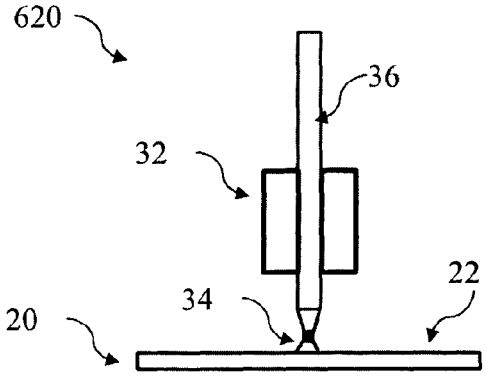
FIG. 6B illustrates a side view of a frangible portion located between the base and the tile alignment portion of the tile spacer according to an embodiment of the present invention.
Figure 7:
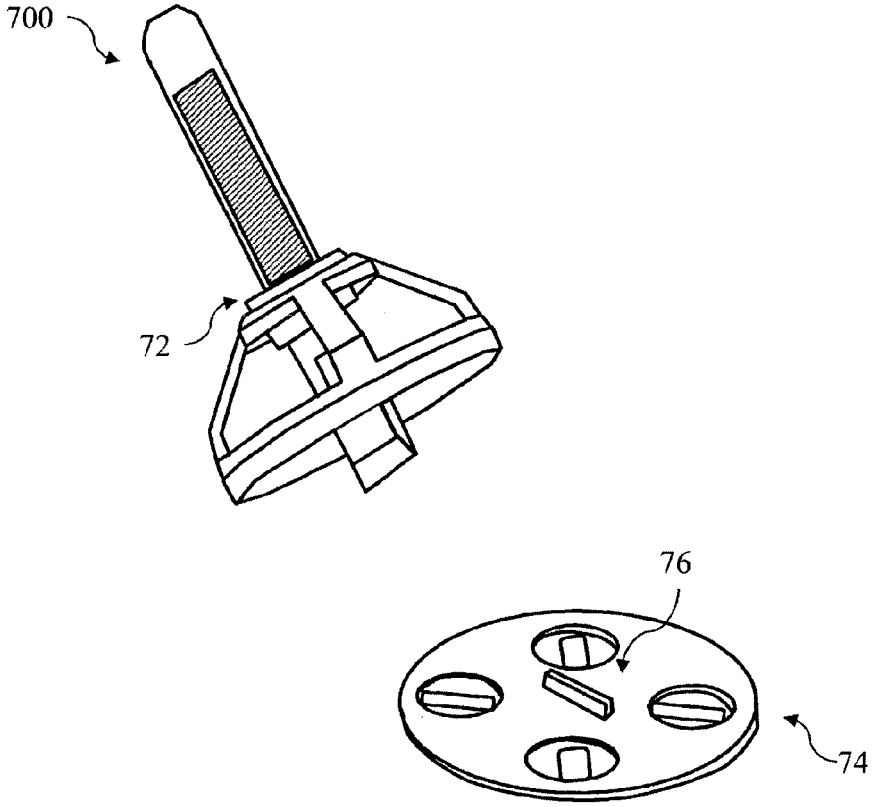
FIG. 7 illustrate perspective views of the stem with an attached tile leveller broken off the base portion according to an embodiment of the present invention.

The frangible portion may be provided by reducing the thickness of the stem 30 or providing channels through the stem, so as to locally weaken the stem. This is illustrated in FIG. 6A which is a perspective view 610 of the frangible portion 34 and FIG. 6B which is a side view 620 of the frangible portion. The stem 30 may be broken off by pulling or kicking the stem 30, leaving the base 20 and stem stub 74 under the tiles. A perspective view 700 of the stem 30 with an attached tile leveller 72 broken off the base 74 portion with stem stub 76 is illustrated in FIG. 7. The base 20 is then left under the tiles, and grout can be placed between the tiles to cover over and seal the tiles together.

Figure 8A:
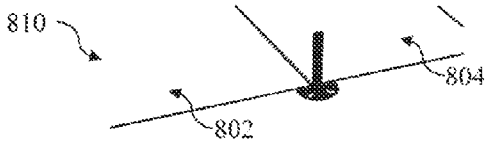
FIGS. 8A-E illustrate perspective views of the use of the tile spacer and levelling system according to an embodiment of the present invention.
Figure 8B:
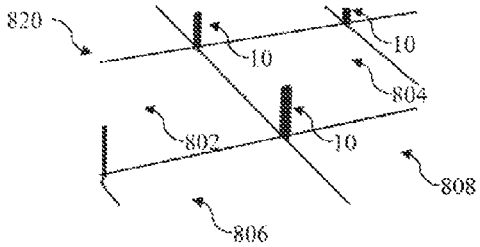

FIGS. 8A-E illustrate perspective views of the use of the tile spacer and levelling system 1. In FIG. 8A (perspective view 810), two adjacent tiles 802, 804 have been laid on a ground surface and a tile spacer 10 is shown located in the top corner which acts to correctly space the tiles 802, 804 apart from each other. The tile spacer 10 may be placed first, followed by the two tiles, or the two tiles may be laid and then the spacer 10 inserted at the corner to ensure correct spacing. In FIG. 8B (perspective view 820), another two tiles 806, 808 are laid. These are placed up against (ie abutting) the tile alignment portion of the spacer 10 to ensure the tiles are correctly aligned and spaced with respect to each other. The spacing is thus controlled by the dimensions of the tile alignment portion.

Figure 8C:
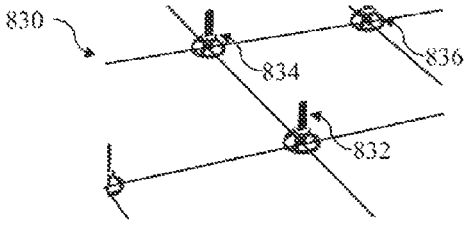
Figure 8D:
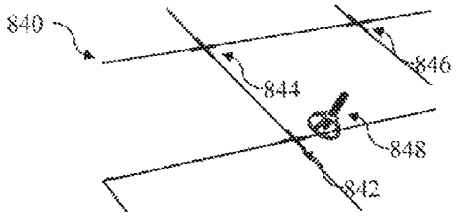
Figure 8E:
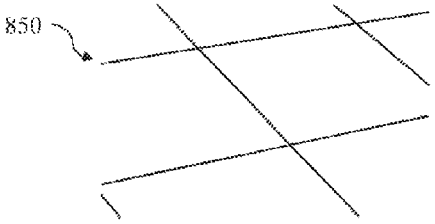
Figure 11A:
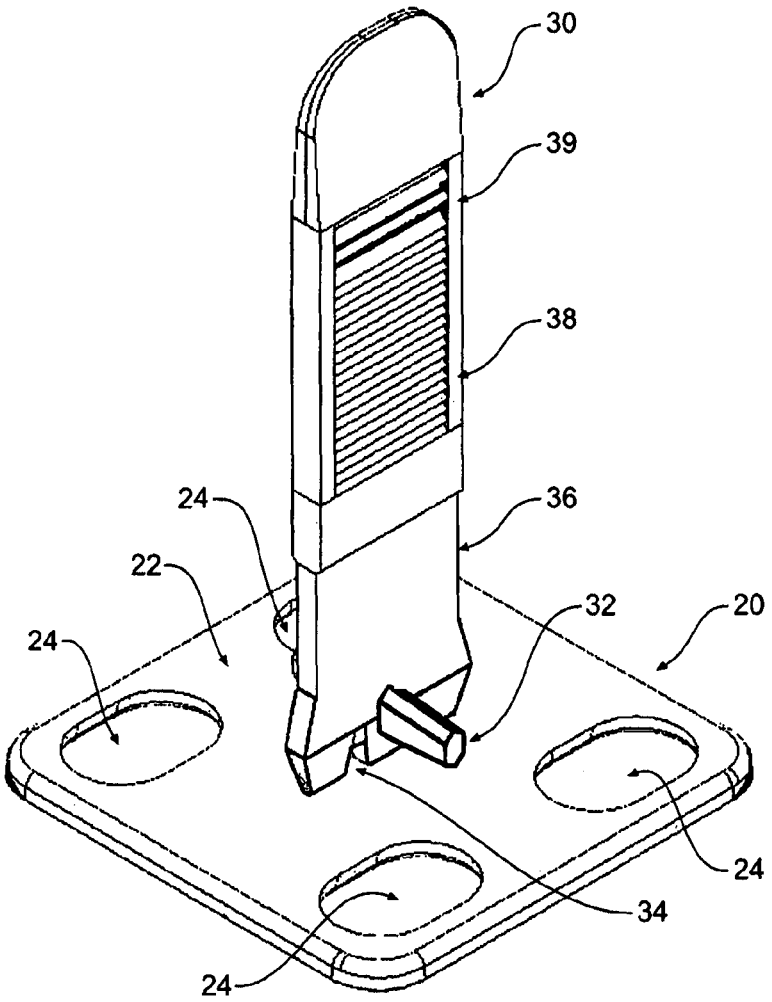
FIG. 11A is a top perspective view of a tile spacer according to an embodiment.
Figure 11B:
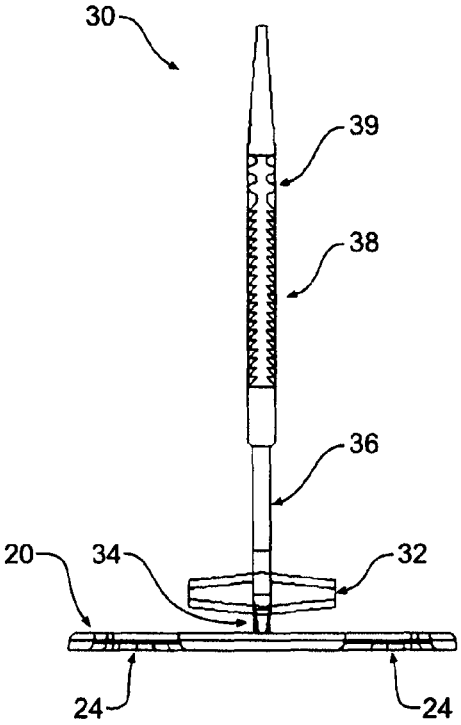
FIG. 11B is a first side view of a tile spacer according to an embodiment.
Figure 11C:
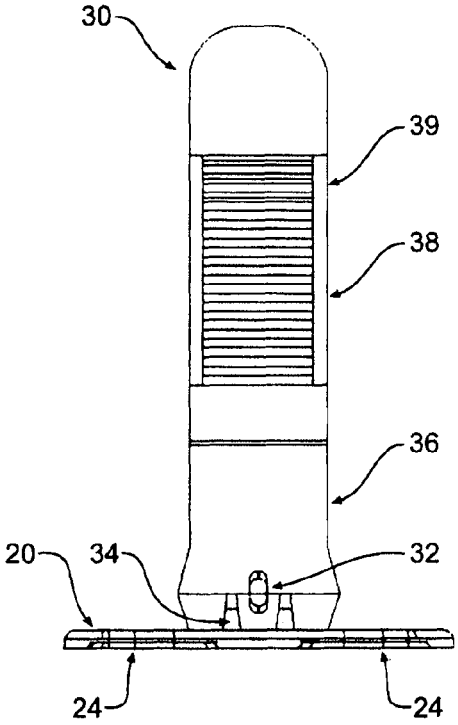
FIG. 11C is a second side view of a tile spacer according to an embodiment.
Figure 11D:
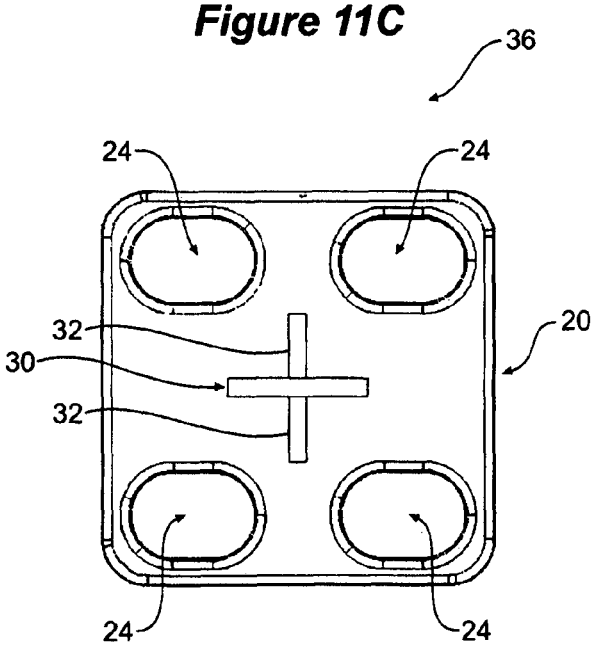
FIG. 11D is a top view of a tile spacer according to an embodiment.

Spacers are used at each corner point to ensure regular spacing of laid tiles and the stems of several spacers extending above the tiles are also shown in FIG. 8B. The levelling hand tool 60 may be used to place levellers over each of the stems and to clamp and simultaneously level the tiles between the tile bottom surface engagement portion and the tile top surface engagement portion of each spacer and leveller. FIG. 8C (perspective view 830), illustrates the levellers fitted over the stems 832 834 836 shown in FIG. 8B. After a suitable time frame, the stem and levellers are separated from the base portions (by severing the stem at the frangible portion). FIG. 8D (perspective view 840), illustrates a stem and leveller just after separation 844, and the bases 842 846 848 visible as crosses through the gaps in the tiles. After removal of the stem and levellers, grout is placed between the gaps in the straight and level tiles. As shown in FIG. 8E (perspective view 850), the bases are covered over and hidden from view;

In the embodiment illustrated in FIGS. 1 to 10, the flat top surface of the plate forms the bottom surface engagement portion, but other embodiment are possible. For example the base 20 may have a rectangular, hexagonal, elliptical, star, cross shape, wheel hub and spoke arrangement or other some shape. FIG. 11A shows another embodiment in which the base 20 is rectangular. The base. 20 is designed to sit below the tiles, and include one or more bottom surface engagement portions. The bottom surface engagement portion may be provided by the upper surface of the base 20, or the base may include upward projections. For example the base 20 could be a flat cross member with a series of upward projections or feet at the end of each of the four arms. As would be apparent to the skilled person, the base 20 acts as a reference or stop which the leveller 40 is pulled towards against so that the leveller uniformly levels each of the tiles it touches. Accordingly, the bottom surface engagement portion (or portions) need only extend under at least one tile. However to ensure uniform force distribution and levelling, it is preferable that the bottom surface engagement portion (or portions) engage with two and more preferably all four of the tiles that the base is located under. The base 20 may have apertures or channels to allow adhesive be located either side of the bottom surface engagement portions or the base may be a solid component without apertures. Additionally the base 20 may include multiple bottom surface engagement portions.

In the embodiment illustrates in FIGS. 1 to 10, the tile leveller 40 further includes an aperture for receiving the stem portion of the tile spacer. However the tile leveller only needs a top surface engagement portion (or portions) so that the tiles can be levelled by applying a clamping force on the four tiles from the one or more tile bottom surface engagement portions and the base 20 to simultaneously level the four tiles. Accordingly, other arrangements could be used. For example, the leveller 40 may be held against the top surface of the tiles in one hand, and the stem portion of the tile spacer may be drawn upward by the other hand to ensure the tiles are squeezed or clamped between the respective top and bottom surface engagement portions of the leveller and spacer. If the tiles are sufficiently heavy, their weight on the tile spacer may be sufficient to ensure the bottom surface of the tile engages with the bottom surface engagement portion without pulling on the stem. In this case, the leveller needs only to be pushed downward to level the tiles. This could be achieved using an inverted cup shaped leveller in which the rim of the cup acts as the top surface engagement portion and which is placed over the stem and pushed down and to apply the clamping force. Alternatively the top surface engagement portion could include a C-shaped member having an arc that spans at least 270° (ie at least three tiles), and which uses resilient arms extending upwards and inwards from the C to clamp onto the stem. The stem could be provided with a series of teeth or steps to act as stops for the arms so that tile leveller can be pushed over the stem. The teeth could have profile in the shaped of a right angled triangle to provide a flat lower edge to the teeth so as to enable one way downward movement of the leveller. The use of a single top surface engaging portion facilitates uniform pressure application to the tiles. However multiple top surface engagement surfaces may be used provided they are able to apply approximately uniform pressure to level the tiles. For example rather than use a wheel 42 at the end of the struts 44, each of the struts may end in separate feet. This embodiment ensures visibility of the tile joint is retained during tile levelling and spacing.

Figure 13:
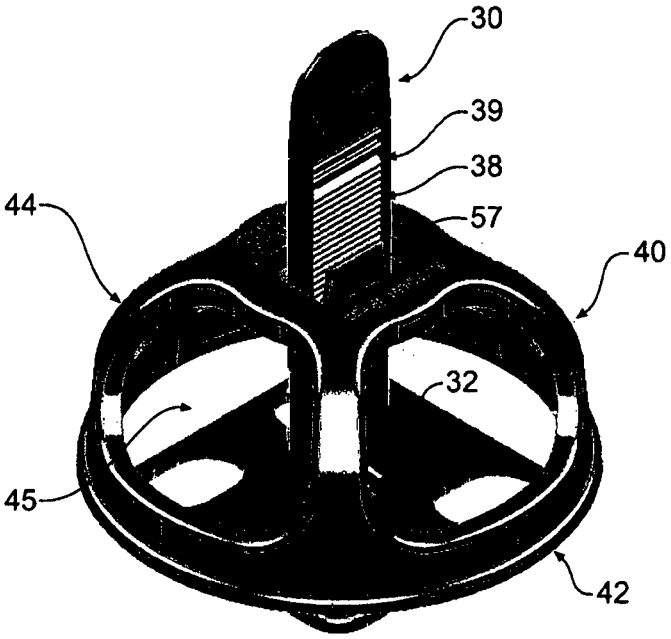
FIG. 13 is a top perspective view of a tile spacer and leveller according to an embodiment.
Figure 14:
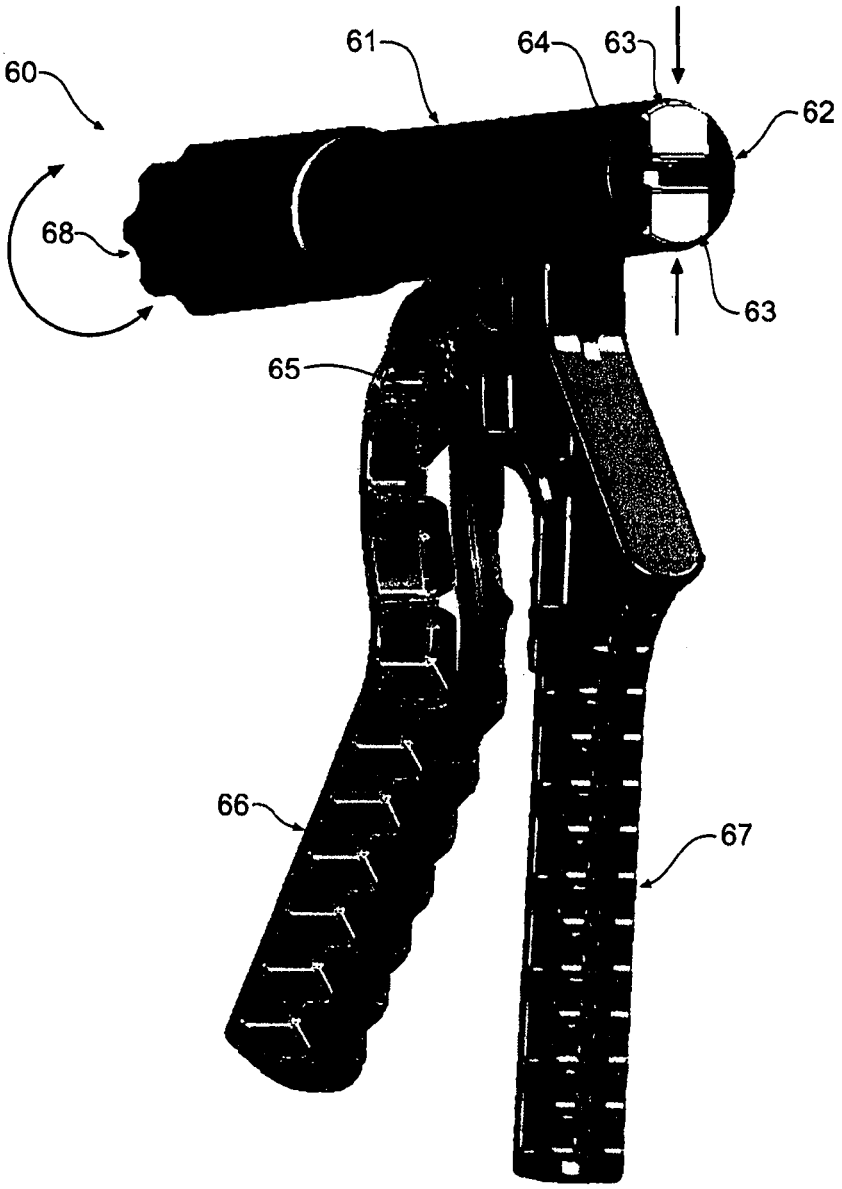
FIG. 14 is a perspective view of a end of the levelling hand tool that engages with a tile leveller and spacer according to an embodiment.
Figure 15:
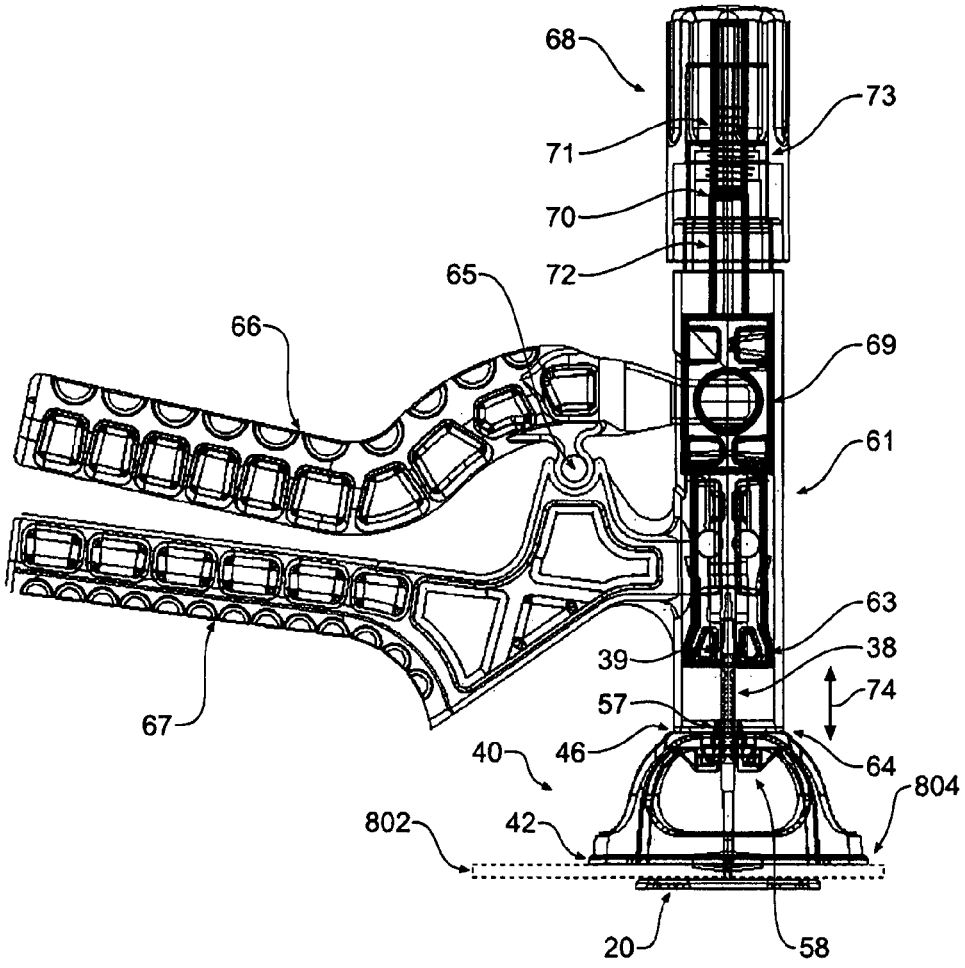
FIG. 15 is a side view of a levelling hand tool engaged with a tile leveller and spacer according to an embodiment.

FIGS. 11A, 11B, 11C and 11D that show a top perspective view, a first view, and second (90° orthogonal) view and a top view, respectively, of an embodiment of an a tile spacer. The inventors have invented this new design for a tile spacer. The ornamental design for the tile spacer as shown in FIGS. 11A to 11D is claimed. FIG. 12 shows a top perspective view of a tile leveller according to an embodiment. FIG. 13 shows a top perspective view of the tile leveller engaged over the stem of this spacer in this embodiment. This embodiment is further adapted for use with an embodiment of a levelling hand tool 60, for which a perspective view is shown in FIG. 14. FIG. 15 is a side view showing the internal components of the levelling hand tool as it is used to engage the stem of the tile spacer and the top of the leveller.

The hand tool 60 comprises a barrel 61 with a stem receiving portion 62 for gripping the stem 30 at the forward end of the barrel. The stem receiving portion 62 comprises a stem receiving aperture surrounded by two laterally movable opposed grips 63 located between two fixed semi-circular arcs which form the forward end of an internal sliding member 69, which is pivotally connected to the trigger arm 66. A grip 67 is fixed to the barrel 61, and a trigger arm 66 is connected to the grip via a pivot 65. The internal sliding member 69 is forwardly biased by a spring so that the stem receiving portion 62 projects slightly out from the end of the barrel. The two laterally movable opposed grips are biased in a radially outward direction to create an aperture for the stem that is wider than the thickness of the stem. As the trigger 66 is squeezed with respect to the grip 67, the trigger rotates above the pivot 65 and forces the internal member 69 to slide rearward within the barrel. The end of the barrel forces the two grips inward and rearward so as to the grip the stem and pull the stem inward. As the internal sliding member 69 and grips are retracted into the barrel, the forward end of the barrel 61 forms the tile leveller engaging portion 64 that provides a forward surface for engagement with the top surface of the tile leveller 46 as shown in FIG. 15. Once the stem is gripped, and the end of the barrel engages with the top surface of the tile leveller 46, continued pressure on the trigger (ie by further squeezing the trigger arm 66 towards the grip 67) forces the tile leveller 40 down the teeth 38 of the stem 30 in a ratcheting manner. As the base 20 of the spacer is fixed under the tiles 802 804, the entire levelling tool is pulled downwards as the trigger is squeezed, and thus the bottom surface 42 of tile leveller 40 is forced against the top surface of the tiles 802 804 to clamp the tiles between the leveller 40 and the base 20 so as to level the four tiles 802 804 806 808 simultaneously.

To assist in the gripping and levelling process, and as can be seen in the top of FIG. 11, the stem of the spacer further comprises two ribs 39 located above the teeth 38. These ribs are larger than the teeth, and act as locating and griping point for the two grips 63 in the end of the levelling hand tool. The two grips 63 act as teeth which locate in the gap between the two ribs 39. More ribs can be provided if desired.

To further assist in the levelling process, a height adjustable stop 70 is provided in the hand levelling tool. The height adjustable stop 70 is a threaded screw 71 fixed or embedded in a cap 68. The rear of the barrel comprises a screw receiving portion 73 such as a fixed nut, which provides complementary threads 73 to receive the screw 71. By rotating the cap 68 the end of the screw 71 can be progressively inserted into the rear end of the barrel, where the end of the screw 71 forms the stop 70 for the rear shaft 72 of the internal sliding member 69. That is as the trigger is squeezed, the location of the cap 68 relative to the end of the barrel 61 determines the location of the end of the screw 71 and thus the location or height of the stop 70 relative to the front end of the barrel, and thus the tile leveller. Thus by rotating the cap, the position of the stop can be controlled to limit rearward movement of the internal sliding member 69, and thus set the maximum separation (or height) difference 74 between the tile leveller engaging portion 64 and the stem receiving portion 63, and thus the maximum downward force applied to the leveller.

The cap 68 acts as an adjustment member so that rotation in one direction causes the stop 70 to move forward along the shaft of the barrel and rotation in the opposite direction causes the stop 70 to move rearward along the shaft of the barrel. In this embodiment, the location of the stop is continuously adjustable. However in other embodiments, the location of the stop could be adjustable in set increments. For example a continuous stepped ladder could be formed on a circular ridge at the rear of the barrel 61. The cap 68 could clip onto the rear of the barrel and include a stop member projecting through an aperture in the rear of the barrel 61, and include a projection biased to rest against the circular ridge. One way rotation would allow a series of heights to be set, with a half or full rotation resetting the stop to a first height.

The adjustable stop can be set to a first set separation distance (or height) to apply sufficient force to level the tiles, and a second separation distance (or height), larger than the first separation distance, to allow application of extra force sufficient to break the stem from the base due to failure of the frangible portion 34. Alternatively the installer could remove the cap, and thus the stop completely. In this embodiment the stem narrows as it joins the base, and two channels are cut through the bottom portion of the stem to form a frangible connection between the base 20 and the stem 30. To assist in setting the separation distance of the stop (ie height or location of the stop relative to the front of the barrel), a series of indicators (marks, a ruler, grooves, coloured lines etc) could be placed on the outside of the end of the barrel 69, and which become exposed as the cap is unscrewed. Predefined marks could be used for specific tile thicknesses or force settings. These could be predetermined in a factory based upon the specific implementation of the system (dimensions, materials, etc). A maximum separation indicator (eg a red line or ring) could also be provided on the rear end of the barrel corresponding to a separation (height) which is expected to be sufficient to cause the frangible portion to break eg based upon the known geometry and material properties of the system, and trial and/or modelling data.

This leads to a method for spacing and levelling tiles. The method comprises:

locating a base of the tile spacer under a first tile and an adjacent second tile;

laying a further two adjacent tiles;

spacing the four adjacent tiles using a tile alignment portion on a stem of the tile spacer;

inserting a tile leveller over the stem of the tile spacer;

setting a stop of a levelling hand tool to a first setting to set a separation distance between a forward end of the levelling hand tool and the stop;

placing the levelling hand tool over the stem and actuating a trigger of the levelling hand tool to pull the stem into the levelling hand tool and thus to force the forward end of the levelling hand tool to engage with tile leveller and force the tile leveller down the stem and against the top of the tiles so as clamp the tiles between the base and the tile leveller so as to level the tiles, until the stop prevents further movement of the stem into the levelling hand tool;

removing the levelling hand tool from the stem;

leaving the tiles in a levelled state for a period of time;

adjusting the stop to increase the separation distance relative to the first setting;

placing the levelling hand tool over the stem and actuating the trigger to pull the stem into the levelling hand tool and to force to the tile leveller and against the top of the tiles to force the frangible portion to break; and removing the stem of the spacer and the tile leveller.

The above described method can be varied as required. For example the spacing operation can be performed as each tile is laid ie a first tile is laid and then the spacer is inserted, and then the second tile is laid and spaced, and then the third tile is laid and spaced and then the fourth tile is laid and spaced. Setting the stop to the first setting can be performed using a calibration or trial process, in which the installer uses a minimum separation distance (and thus force) setting and gradually increases until an appropriate height setting is found which is sufficient to level the tiles without breaking the stems. Once the first or levelling setting is located, the installer can then lay the tiles, using the tile leveller and spacer system to correctly spacing and level the tiles, without having to adjust the tool. The use of struts 44 and viewing apertures 45 in the leveller, along with transparent stem, allows the installer to inspect the tile joints to ensure all have been correctly spaced and levelled, and to make any required adjustments before the adhesive as set. Thus having laid the tiles the installer can let the adhesive cure, and then return later (for example the next day) to remove the stems and insert grouting to finish the tiling job. On return the installer can adjust the tool to a height setting sufficient to force the frangible portion to break when the trigger is squeezed. Adjusting the stop can include removing the stop completely, or setting the stop to a predetermined separation distance or a maximum separation distance. Once the height of the stop has been set, the installer can proceed to apply the tool to each spacer to break off all of the stems in the laid tiles.

To keep manufacturing costs low, the tile spacer and tile leveller may be injection moulded plastic components. However, other manufacturing techniques and materials may be used. The tile spacer, and or tile leveller can be constructed to a translucent or transparent plastic or other suitable material, to improve the visibility of the tile joint during and after spacing and levelling operations. The stem may include a ruler or height markings to indicate the height relative to the top of the base 22. In one embodiment, the diameter of the barrel is 25.4 mm, the length of the barrel is 137 mm, the length of the internal sliding member is 108.5 mm and the length of the cap is 59.25 mm. The height of the spacer is 68.5 mm and the base is a square with a side of 42.5 mm and is 2 mm thick. The stem is 15 mm wide. The tile spacer has an outer diameter of 64 mm, and a height of 30.5 mm.

The tile spacer and levelling system described herein has a number of advantages over prior art spacers. Firstly the system allows spacing and levelling. The tile spacer can be placed at junction points of tiles to ensure tiles will be correctly spaced when laid and not be misaligned. It guides the user into lining up tiles with precision and the mechanism allows the edges of the tiles to align at the same height and distance from one another to provide a pleasing aesthetic appearance. The system also provides ease of installation and repeatability, and thereby reduces the overall installation time. Further the base can be separated from the spacer to ensure compliance with the Australian Standard. The use of struts and viewing apertures in the tile spacer allows the installer to visually inspect that the tiles are correctly spaced and levelled after applying the leveller. To further improve visibility the stem and tile alignment portion (the cross) can be constructed of transparent plastic. Thus both during after use the installer has almost full visibility of the tile joint. A tile levelling tool can also be used to assist with the levelling operation. The stem can be provided with reference ribs for the levelling tool and the tool can include a height adjustable stop to allow the installer control the maximum separation distance between the reference ribs and the leveller to facilitate separate and repeatable levelling and stem breaking operations.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A tile spacer and levelling system comprising:

(a) a tile spacer comprising:

a base for engaging a bottom surface of each of four adjacent tiles to be spaced and levelled;

a stem projecting upward from the base, the stem comprising:

a tile alignment portion having a cross-shaped profile;

a frangible portion located between the base and the tile alignment portion;

a plurality of teeth located above the tile alignment portion, and one or more ribs;

(b) a tile leveller for engaging a top surface of the four adjacent tiles, the tile leveller comprising an aperture for receiving the stem portion of the tile spacer, a ratchet mechanism such that the tile leveller is restricted to only move downward along the stem toward the base, a stem engaging portion comprising one or more projections for engaging with the plurality of teeth of the stem portion, wherein at least one of the projections and teeth are resilient and orientated to allow one way movement of the stem with respect to the stem engaging portion; and (c) a levelling hand tool comprising a stem receiving portion comprising a pair of laterally movable opposed grips for engaging and gripping the ribs of the stem, a tile leveller engaging portion, a trigger, a trigger mechanism, and height adjustable stop for allowing a user to set the maximum height difference between the tile leveller engaging portion and the stem receiving portion, wherein, in use, the tile spacer is located at the intersection of the four adjacent tiles such that the base is located beneath the four adjacent tiles, and each tile abuts a corner of the alignment portion so as to space the four adjacent tiles at a predetermined distance with respect to each other;

wherein, in use, the four adjacent tiles are levelled by applying a clamping force on the four adjacent tiles between the base and the tile leveller, to simultaneously level the four adjacent tiles; and wherein, in use, actuating the trigger of the levelling hand tool causes the stem receiving portion to be pulled inward with respect to the tile leveller engaging portion so that the pair of laterally movable opposed grips engage and grip the ribs of the stem and cause the application of the clamping force and levelling of the tiles.

2. The tile spacer and levelling system as claimed in claim 1, wherein the levelling hand tool further comprises a barrel, an internal sliding member located within the barrel, a grip and a cap, wherein the forward end of the barrel forms the tile leveller engaging portion, and the rear end of the barrel comprises a threaded aperture, and the cap comprises a threaded shaft that screws into and extends through the threaded aperture and the end of the shaft forms the stop, and the stem receiving portion is located at a forward end of the internal sliding member and is pivotally connected to the trigger, and the trigger is pivotally connected to the grip that is connected to the barrel, such that actuation of the trigger causes the internal sliding member to slide rearward within the barrel until it hits the stop, and the height of the stop relative to the forward end of the barrel is adjustable by screwing the cap, wherein screwing the cap in one direction adjusts the stop inward along the axis of the barrel and screwing the cap in the opposite direction adjusts the stop outward along the axis of the barrel.

3. The tile spacer and levelling system as claimed in claim 1, wherein the one or more ribs are located at or above the top of the plurality of teeth on the stem portion.

4. The tile spacer and levelling system as claimed in claim 1, wherein the tile leveller comprises a wheel member, and a flat lower surface of the wheel member engages the top surface of the four adjacent tiles, and central portion comprising the aperture and the stem engaging portion, and a plurality of struts that connect the wheel member to the central portion.

5. The tile spacer and levelling system as claimed in claim 1 wherein the tile leveller comprises a wheel member, and a flat lower surface of the wheel member engages the top surface of the four adjacent tiles, and central portion comprising an aperture for receiving the stem portion of the tile spacer and a plurality of struts that connect the wheel member to the central portion.

6. The tile spacer and levelling system as claimed in claim 1, wherein the tile spacer and tile leveller are injection moulded components.

7. The tile spacer and levelling system as claimed in claim 1, wherein the tile spacer is constructed of a translucent or transparent plastic.

* * * * *